US011937652B2

(12) United States Patent
Gilbert

(10) Patent No.: US 11,937,652 B2
(45) Date of Patent: Mar. 26, 2024

(54) LEGGINGS WITH CROTCH GUSSET ASSEMBLIES

(71) Applicant: OYA Femtech Apparel, Inc., Los Angeles, CA (US)

(72) Inventor: Mitchella Gilbert, Los Angeles, CA (US)

(73) Assignee: OYA Femtech Apparel, Inc., Los Angeles, CA (US)

( * ) Notice: Subject to any disclaimer, the term of this patent is extended or adjusted under 35 U.S.C. 154(b) by 27 days.

(21) Appl. No.: 17/667,031

(22) Filed: Feb. 8, 2022

(65) Prior Publication Data

US 2022/0248777 A1 Aug. 11, 2022

Related U.S. Application Data

(60) Provisional application No. 63/148,588, filed on Feb. 11, 2021.

(51) Int. Cl.
*A41D 1/08* (2018.01)
*A41B 11/00* (2006.01)

(52) U.S. Cl.
CPC ..... *A41D 1/088* (2013.01); *A41B 11/006* (2013.01); *A41D 1/08* (2013.01)

(58) Field of Classification Search
CPC ..... A41D 1/088; A41D 1/08; A41D 27/28; A41D 31/125; A41B 11/006
See application file for complete search history.

(56) References Cited

U.S. PATENT DOCUMENTS

| | | | | |
|---|---|---|---|---|
| 1,106,310 | A | 8/1914 | Kelly | |
| 1,255,820 | A | 2/1918 | Oppenheim | |
| 4,236,257 | A | 12/1980 | Williams et al. | |
| 4,371,989 | A * | 2/1983 | Polsky | A41D 1/08 2/407 |
| 4,488,317 | A * | 12/1984 | Polsky | A41D 1/08 2/401 |
| 4,630,320 | A | 12/1986 | Van Gompel | |
| 4,785,480 | A * | 11/1988 | Polsky | A41D 1/06 2/401 |
| 5,330,598 | A * | 7/1994 | Erdman | A61F 13/49473 156/229 |
| 6,209,143 | B1 | 4/2001 | Hancock | |
| 6,817,030 | B2 | 11/2004 | Desai | |
| 7,100,214 | B1 * | 9/2006 | Murray | A41C 1/003 2/408 |
| 7,323,615 | B2 | 1/2008 | Gustavsson et al. | |

(Continued)

FOREIGN PATENT DOCUMENTS

EP 2879534 B1 3/2017

*Primary Examiner* — Khaled Annis
(74) *Attorney, Agent, or Firm* — Chong IP Law Group

(57) ABSTRACT

Leggings with a crotch gusset assembly and inner thigh mesh panels are provided. Leggings having a crotch gusset assembly, may include a first leg for receiving a user's first leg; a second leg for receiving a user's second leg; a first inner thigh mesh panel and a second inner thigh mesh panel for providing ventilation; and a crotch gusset assembly having at least one inside gusset panel and an outer gusset panel, wherein the at least one inside gusset panel and the outer gusset panel are attached to form a pocket for retaining a removable absorbent pad.

13 Claims, 13 Drawing Sheets

(56) References Cited

U.S. PATENT DOCUMENTS 7,500,274 B1 * 3/2009 Kallen ..... A41D 1/086 2/227
8,118,798 B1 2/2012 Campbell
8,561,213 B2 * 10/2013 Howell ..... F41H 1/02 2/2.5
8,850,614 B1 10/2014 Connor
8,935,813 B2 * 1/2015 O'Leary ..... A41B 9/001 2/400
9,003,571 B1 * 4/2015 Lewis-Williams ..... A41B 9/04 2/400
9,375,364 B2 6/2016 Suzuki et al.
10,244,798 B2 4/2019 Wexler
10,555,564 B2 * 2/2020 Brady ..... A41B 9/005
11,154,431 B1 * 10/2021 Yip ..... A41B 17/00
2005/0176324 A1 * 8/2005 Michel ..... A41B 11/14 2/241
2006/0230488 A1 * 10/2006 Rudolph ..... A41D 1/086 2/69
2007/0021727 A1 * 1/2007 Fabrega ..... A61F 13/84 604/385.19
2008/0015538 A1 * 1/2008 Deerin ..... A61F 13/505 604/397
2008/0114327 A1 5/2008 Barge
2008/0125737 A1 5/2008 Modgeddi et al.
2008/0222770 A1 * 9/2008 Oates ..... A41D 1/088 2/408
2010/0269243 A1 * 10/2010 Paree ..... A41B 9/005 2/243.1
2011/0302686 A1 * 12/2011 Chapuis ..... A41D 13/0015 2/242
2013/0125293 A1 * 5/2013 Stearns ..... A41D 1/06 2/227
2015/0082519 A1 3/2015 Yoo
2015/0223524 A1 * 8/2015 Brady ..... A41D 1/089 450/156
2015/0313302 A1 11/2015 Boyle
2016/0295933 A1 * 10/2016 Herbener ..... A41D 27/20
2017/0266537 A1 * 9/2017 Zakem ..... A41D 13/05
2018/0020746 A1 * 1/2018 Wyner ..... A41D 1/088 2/237
2018/0263299 A1 * 9/2018 Padin ..... A41C 1/003
2018/0325189 A1 * 11/2018 Stallbaum ..... A41D 1/08
2018/0325196 A1 * 11/2018 Miller ..... D06M 23/16
2019/0014831 A1 * 1/2019 Chia ..... A41D 1/067
2019/0150540 A1 * 5/2019 Otashevich ..... A41D 1/06
2019/0297972 A1 * 10/2019 Holmes ..... A41F 9/025
2019/0351278 A1 * 11/2019 Walker ..... A63B 21/00061
2020/0068961 A1 * 3/2020 Cohen ..... A41B 9/04
2020/0390161 A1 12/2020 Liou
2021/0112889 A1 * 4/2021 Bentz ..... A41D 1/08
2021/0352970 A1 * 11/2021 Monaco ..... A41B 9/005
2022/0248777 A1 * 8/2022 Gilbert ..... A41D 1/088
2022/0264968 A1 * 8/2022 Bentz ..... A41D 1/06
2022/0331176 A1 * 10/2022 Rogers ..... A61F 13/15252

* cited by examiner

LEGGINGS WITH CROTCH GUSSET ASSEMBLIES

CROSS-REFERENCE TO RELATED APPLICATION

This application claims priority to provisional application Ser. No. 63/148,588, filed on Feb. 11, 2021, the entire contents of which are hereby incorporated by reference as if fully set forth.

FIELD OF THE INVENTION

The present disclosure generally relates to leggings and more specifically to leggings with crotch gusset assemblies.

BACKGROUND

Leggings may be close-fitting coverings worn over a wearer's legs. Typically, leggings are elastic and may be made from synthetic fibers, various fabrics, and/or fabric blends. Leggings may be worn for fashion, as exercise wear, or everyday wear. Leggings may come in a variety of lengths and sizes and be available in many colors, prints, and designs. Beyond appearances, leggings may also be functional in providing warmth and may be worn for athletic purposes.

SUMMARY OF THE INVENTION

The various embodiments of the present leggings with crotch gusset assemblies contain several features, no single one of which is solely responsible for their desirable attributes. Without limiting the scope of the present embodiments, their more prominent features will now be discussed below. After considering this discussion, and particularly after reading the section entitled "Detailed Description," one will understand how the features of the present embodiments provide the advantages described herein.

The present embodiments include legging for providing improved air flow and circulation to the crotch area as well as fluid absorbency through ventilation panels (e.g., inner thigh mesh panels), a crotch gusset assembly, and a removable absorbent pad. For example, a wearer of the leggings may choose to insert the absorbent pad into the crotch gusset assembly where the absorbent pad may absorb discharge and other fluids. The wearer may remove the absorbent pad after use (e.g., when it is full) to wash it and then reuse it. Using a crotch gusset assembly which may include mesh and mesh inner thigh panels, the wearer may experience improved air flow and circulation to the crotch, preventing the buildup of unpleasant odors, sweat, or harmful bacteria. Thus, a more comfortable and healthy legging may be provided to the wearer—one that accounts for natural body processes to absorb fluids and avoid unpleasant buildup.

In operation, one may wear the leggings in a normal manner. As described herein, the wearer may, when desired, insert the removable absorbent pad into the crotch gusset assembly via an opening in the at least one inside gusset panel. In some embodiments, the opening may be created by overlapping inside gusset panels, as further described below. With the removable absorbent pad inserted, the leggings may have various effects to improve genital health and wearer comfortability. For example, the removable absorbent pad may absorb discharge, urine, and other fluids to avoid uncomfortable wetness by the wearer. Further, the removable absorbent pad may be machine washable to ensure odor or bacteria does not build up in the absorbent pad, and thus the leggings. In addition, the at least one inside gusset panel (e.g., the overlapping inside gusset panels) may be constructed using an antibacterial mesh fabric to create a layer of protection against harmful bacteria between the wearer's genitals and the fluids contained in the absorbent pad. In addition, an outer gusset panel of the crotch gusset assembly may be constructed using mesh to avoid trapping odor and bacteria in the leggings. Moreover, the inner thigh mesh panels may allow for increased circulation to the crotch.

In a first aspect, a leggings having a crotch gusset assembly is provided, the leggings comprising: a first leg for receiving a user's first leg; a second leg for receiving a user's second leg; a first inner thigh mesh panel and a second inner thigh mesh panel for providing ventilation; and a crotch gusset assembly comprising at least one inside gusset panel and an outer gusset panel, wherein the at least one inside gusset panel and the outer gusset panel are attached to form a pocket for retaining a removable absorbent pad In an embodiment of the first aspect, the first leg comprises a first front panel and a first back panel and the second leg comprises a second front panel and a second back panel.

In another embodiment of the first aspect, the first front panel and the second front panel are attached and wherein the first back panel and the second back panel are attached.

In another embodiment of the first aspect, the first inner thigh mesh panel and the first front panel are attached; the first inner thigh mesh panel and the first back panel are attached; the second inner thigh mesh panel and the second front panel are attached; and the second inner thigh mesh panel and the second back panel are attached.

In another embodiment of the first aspect, the crotch gusset assembly is attached to the first and second inner thigh mesh panels.

In another embodiment of the first aspect, the crotch gusset assembly is attached to the first and second front panels.

In another embodiment of the first aspect, the crotch gusset assembly is attached to and the first and second back panels.

In another embodiment of the first aspect, the leggings further comprise a waistband providing an opening for entering and exiting the leggings, wherein the waistband is attached to the first and second front panels, and the first and second back panels.

In another embodiment of the first aspect, the leggings further comprise a first side panel, wherein the first side panel is attached to the first front panel and the first back panel.

In another embodiment of the first aspect, the leggings further comprise a first side pocket attached to the first side panel.

In another embodiment of the first aspect, the leggings further comprise a second side panel, wherein the second side panel is attached to the second front panel and the second back panel.

In another embodiment of the first aspect, the leggings further comprise a second side pocket attached to the second side panel.

In another embodiment of the first aspect, the at least one inside gusset panel comprises a top inside gusset panel and a bottom inside gusset panel.

In another embodiment of the first aspect, the top inside gusset panel comprises a first edge and a second edge and the bottom inside gusset panel comprises a first edge and a second edge.

In another embodiment of the first aspect, the first edge of the top inside gusset and the first edge of the bottom inside gusset are attached to form an opening of the crotch gusset assembly for receiving the removable absorbent pad.

In another embodiment of the first aspect, the top and bottom inside gusset panels are attached with the outer gusset panel to form the pocket of the crotch gusset assembly.

In another embodiment of the first aspect, the removable absorbent pad comprises a plurality of layers.

In another embodiment of the first aspect, the plurality of layers comprises a top layer that is moisture wicking.

In another embodiment of the first aspect, the plurality of layers comprises at least one mid layer that is fluid absorbent.

In another embodiment of the first aspect, the plurality of layers comprises a bottom layer that is water resistant.

DETAILED DESCRIPTION OF THE DRAWINGS

Figure 1A:
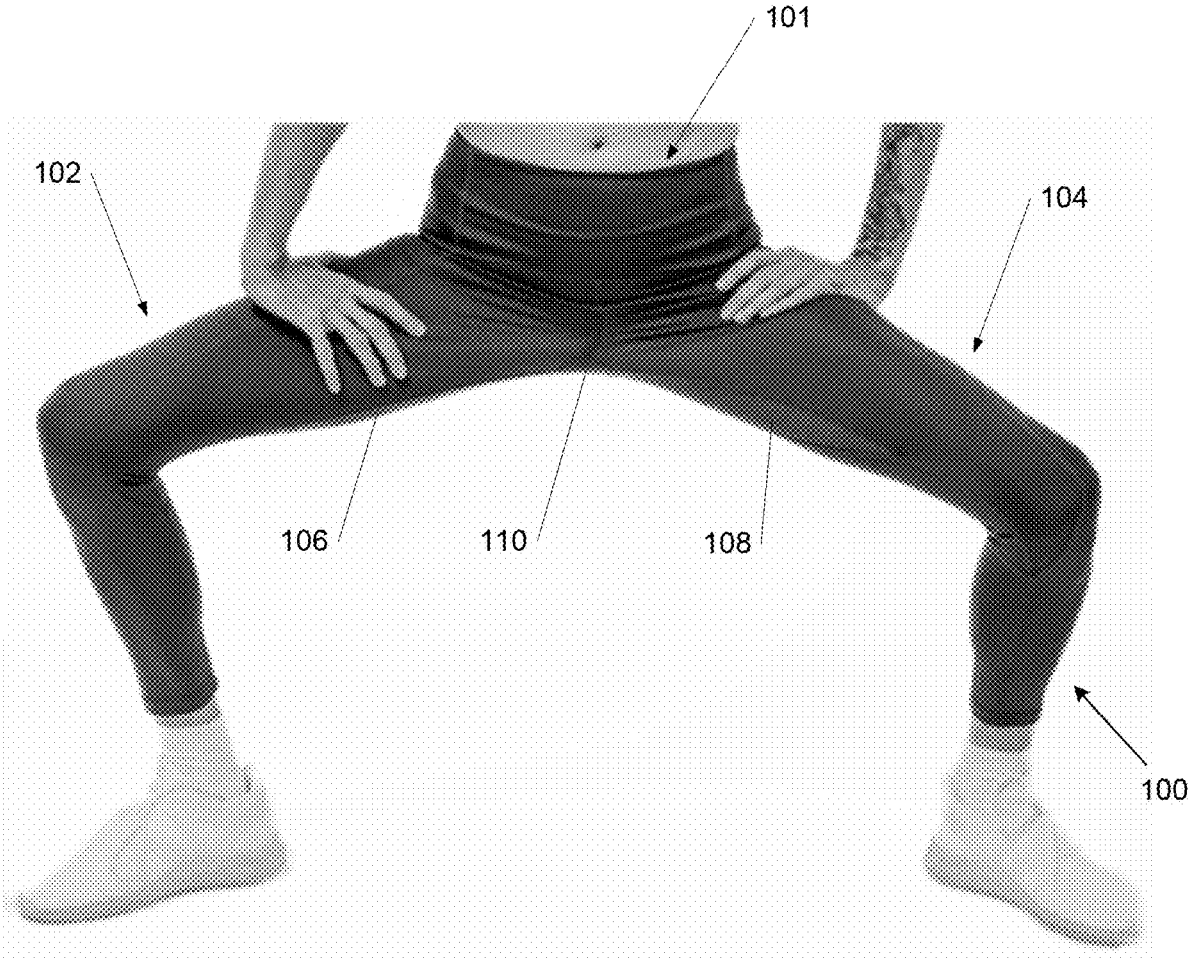
FIG. 1A is a front perspective view of leggings utilizing a crotch gusset assembly and inner thigh meshes in accordance with an embodiment of the invention.

The following detailed description describes the present embodiments with reference to the drawings. In the drawings, reference numbers label elements of the present embodiments. These reference numbers are reproduced below in connection with the discussion of the corresponding drawing features.

The embodiments of the present leggings with crotch gusset assemblies are described below with reference to the figures. These figures, and their written descriptions, indicate that certain components of the apparatus are formed integrally, and certain other components are formed as separate pieces. Those of ordinary skill in the art will appreciate that components shown and described herein as being formed integrally may, in alternative embodiments, be formed as separate pieces. Those of ordinary skill in the art will further appreciate that components shown and described herein as being formed as separate pieces may in alternative embodiments be formed integrally. In addition, the term "attached" may be used interchangeably herein with terms "connected" or "bonded" or any other term indicating connection between one or more parts.

Turning now to the drawings, leggings with crotch gusset assemblies in accordance with embodiments of the invention are disclosed. In many embodiments, leggings may include a crotch gusset assembly and ventilation panels (e.g., inner thigh mesh panels) for increasing air flow, reducing sweat and fluid accumulation, and/or reducing bacteria buildup. In various embodiments, crotch gusset assemblies may include at least one inside gusset panel and an outer gusset panel to form a crotch gusset pocket for receiving and retaining a removable absorbent pad (may also be referred to as an "absorbent pad" or "pad"). In several embodiments, the pad may be antimicrobial, absorbent, removable, and/or reusable. In some embodiments, the absorbent pad may absorb urinary, menstrual, and/or sweat leaks. In some embodiments, the absorbent pad may block odor. In operation, absorbent pads may allow a wearer (may also be referred to as "user") to not have to wear underwear with the leggings. In many embodiments, the ventilation panels may include antimicrobial mesh panels to create air flow and kill bacteria. For example, the leggings may include hidden mesh panels along the inner thighs and/or the crotch gusset assembly. In some embodiments, the at least one inside gusset panel and the outer gusset panel may also be made of mesh so that the crotch area, including vaginas, may breathe comfortably without building up sweat or bacteria. In various embodiments, the crotch gusset pocket may be invisible from the outside and the mesh is typically not see through. Leggings with crotch gusset assemblies and inner thigh mesh panels in accordance with embodiments of the invention are further discussed below.

Leggings with Crotch Gusset Assemblies and Inner Thigh Mesh Panels

Leggings may include crotch gusset assemblies and ventilation panels including, but not limited to, inner thigh mesh panels. Typically, leggings with crotch gusset assemblies and inner thigh mesh panels (may be referred to herein as "leggings") may be constructed utilizing a plurality of panels (e.g., front panels, side panels, back panels, inner thigh mesh panels, etc.), as further described below. Further, leggings may be constructed using one or more synthetic fibers, fabrics, and/or fabric blends. For example, leggings may be constructed primarily using a fabric blend, such as, but not limited to, a polyamide and elastane fabric blend.

FIG. 1A is a front perspective view of leggings utilizing a crotch gusset assembly and inner thigh meshes in accordance with an embodiment of the invention. The leggings 100 may include a waistband 101, a first leg 102, and a second leg 104. In many embodiments, the waistband 101 may be a wideband panel. In some embodiments the waistband 101 may include a plurality of panels such as a front waistband panel and a back waistband panel, as further described below. In some embodiments, the first leg 102 may include a first front panel, a first back panel, and a first side panel, as further described below. Likewise, the second leg 104 may include a second front panel, a second back panel, and a second side panel, as further described below. In many embodiments, the leggings 100 may include a first inner thigh mesh panel 106, a crotch gusset assembly 110, and a second inner thigh mesh panel 108, as further described below.

Figure 1B:
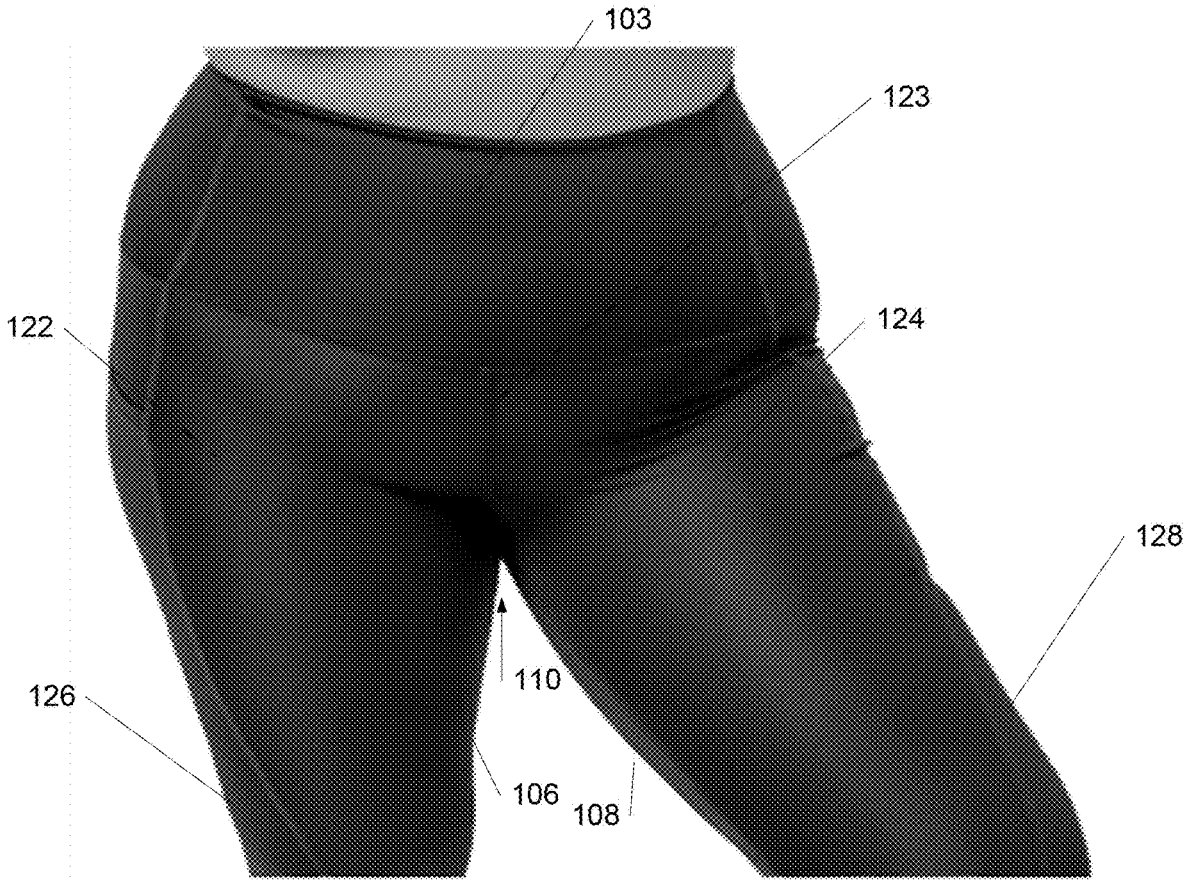
FIG. 1B is a front view of leggings utilizing a crotch gusset assembly and inner thigh meshes panels (may also be referred to as "inner thigh meshes") in accordance with an embodiment of the invention.
Figure 1C:
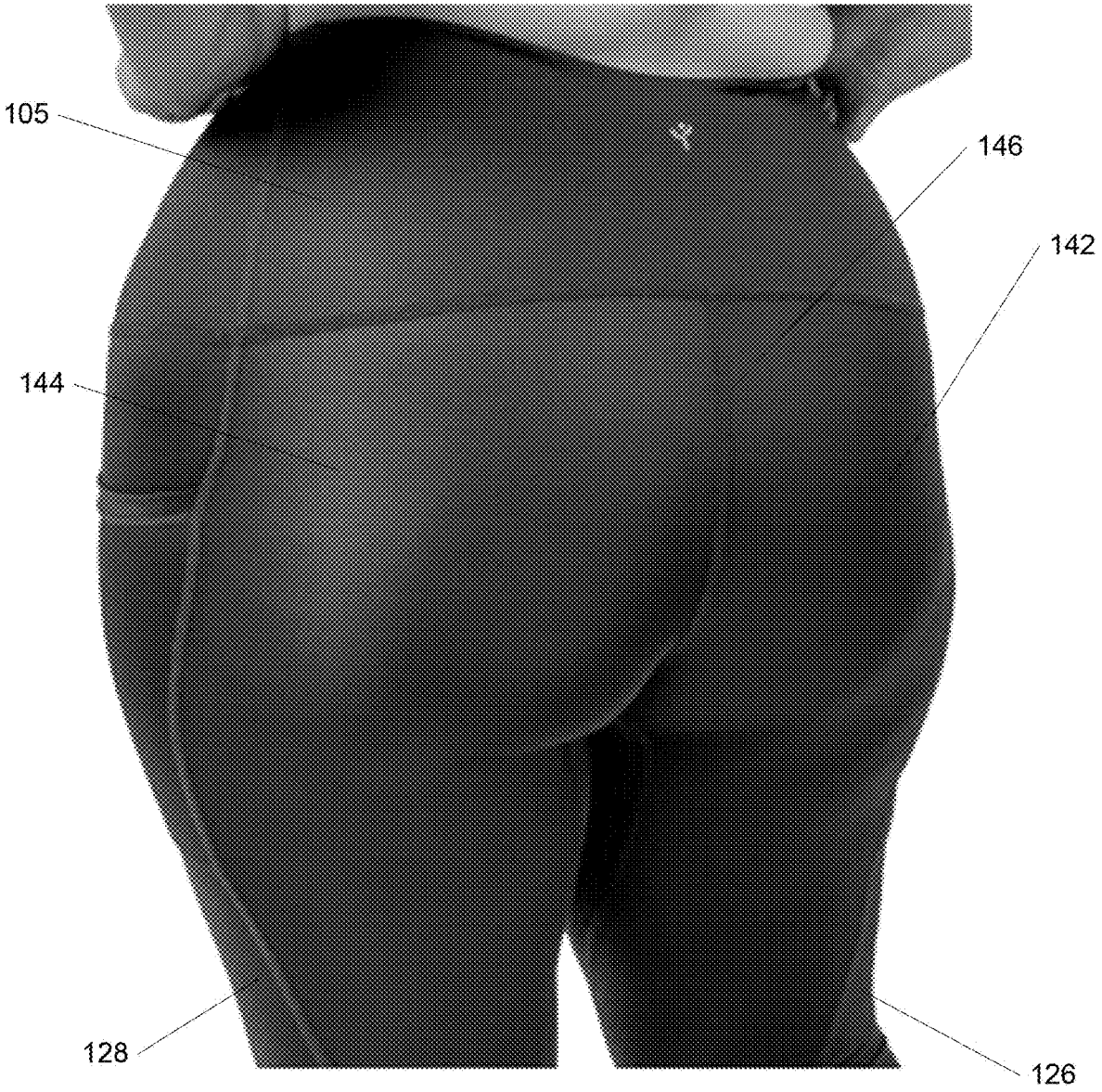
FIG. 1C is a back view of leggings utilizing a crotch gusset assembly and inner thigh meshes in accordance with an embodiment of the invention.

Front and back views of leggings utilizing a crotch gusset assembly and inner thigh meshes in accordance with an embodiment of the invention are shown in FIGS. 1B and 1C, respectively. In reference to FIG. 1B, the top portion of the leggings may include a front waistband panel 103. The front waistband panel 103 may be attached to a first front panel 122 and a second front panel 124. In some embodiments, the first front panel 122 and the second front panel 124 may extend down the front of the leggings to a user's knees. In some embodiments, the first and second front panels 122, 124 may be attached at a seam 123. In reference to FIG. 1C, the top portion of the leggings may include a back waistband panel 105. The back waistband panel 105 may be attached to a first back panel 142 and a second back panel 144. In some embodiments, the first back panel 142 and the second back panel 144 may extend down the back of the leggings to behind the user's knees. In some embodiments, the first and second back panels 142, 144 may be attached at a seam 146. Further, the leggings may include a first side panel 126 and a second side panel 128. In some embodiments, the first front panel 122 and the first back panel 142 may be attached to the first side panel 126, as further described below. In some embodiments, the second front panel 124 and the second back panel 144 may be attached to the second side panel 128, as further described below.

In various embodiments, the leggings may include a first inner thigh mesh panel 106 that may connect at a concave base to an outer gusset panel of a crotch gusset assembly 110. In some embodiments, two sides of the first inner thigh mesh panel 106 may connect to the first front panel 122 and the first back panel 142, as further described below. The leggings may also include a second inner thigh mesh panel 108 may that connect at a concave base to the outer gusset panel of the crotch gusset assembly 110. In some embodiments, two sides of the second inner thigh mesh panel 108 may connect to the second front panel 124 and the second back panel 144, as further described below. As further described below, a pointed end of the outer gusset panel may be attached to the seam 123 between the first and second front panels 122, 124. Another pointed end of the outer gusset panel may be attached to the seam 146 between the first and second back panels 142, 144. In addition, the front waistband panel 103 and the back waistband panel 105 may be attached together at seams on the wearer's left and right sides. Moreover, the front and back waistband panels 103, 105, first and second front panels 122, 124, and the first and second back panels 142, 144 may be made using a primary legging fabric blend such as, but not limited to, a polyamide and elastane fabric blend.

Figure 1D:
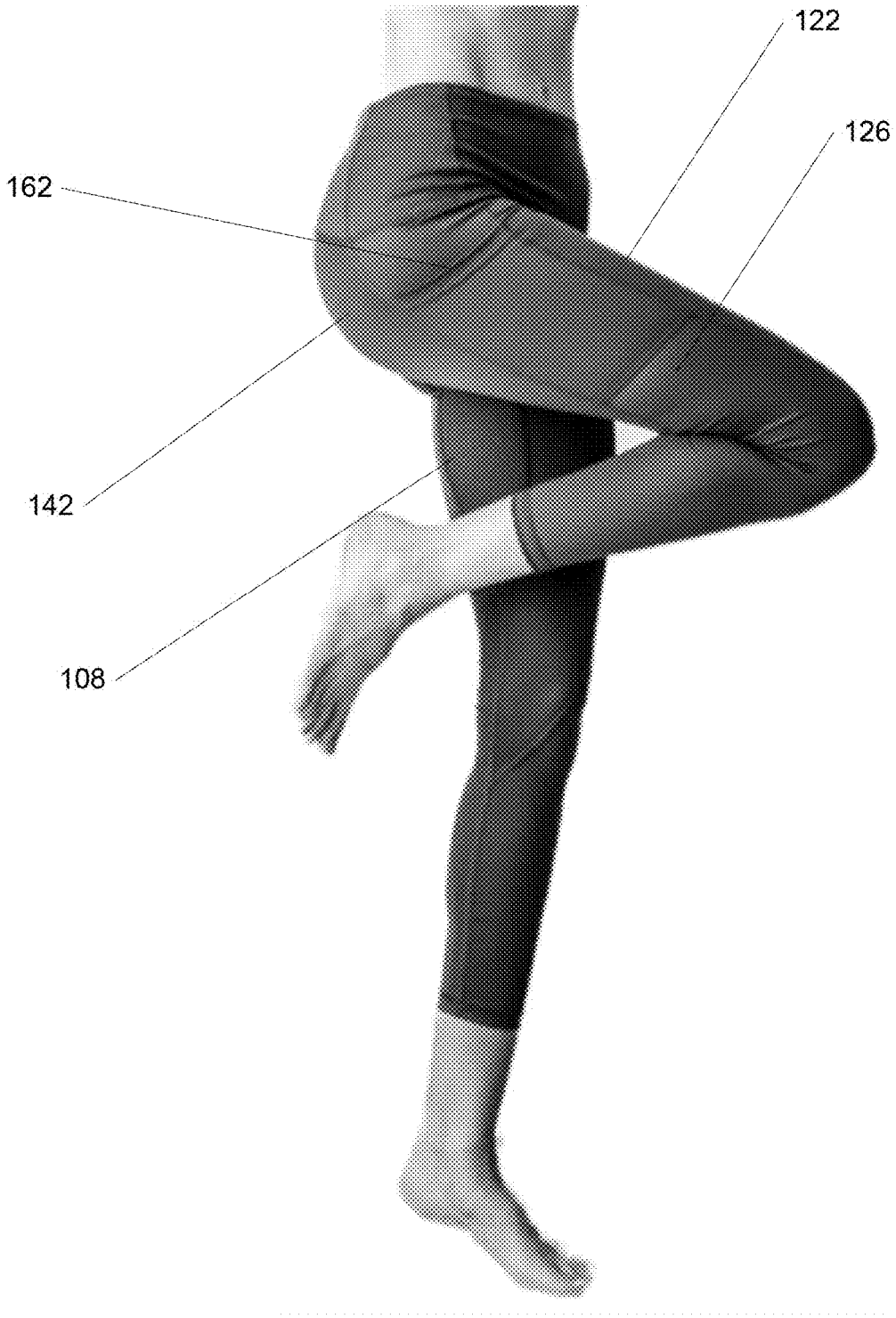
FIG. 1D is a right side view of leggings utilizing a crotch gusset assembly and inner thigh meshes in accordance with an embodiment of the invention.
Figure 1E:
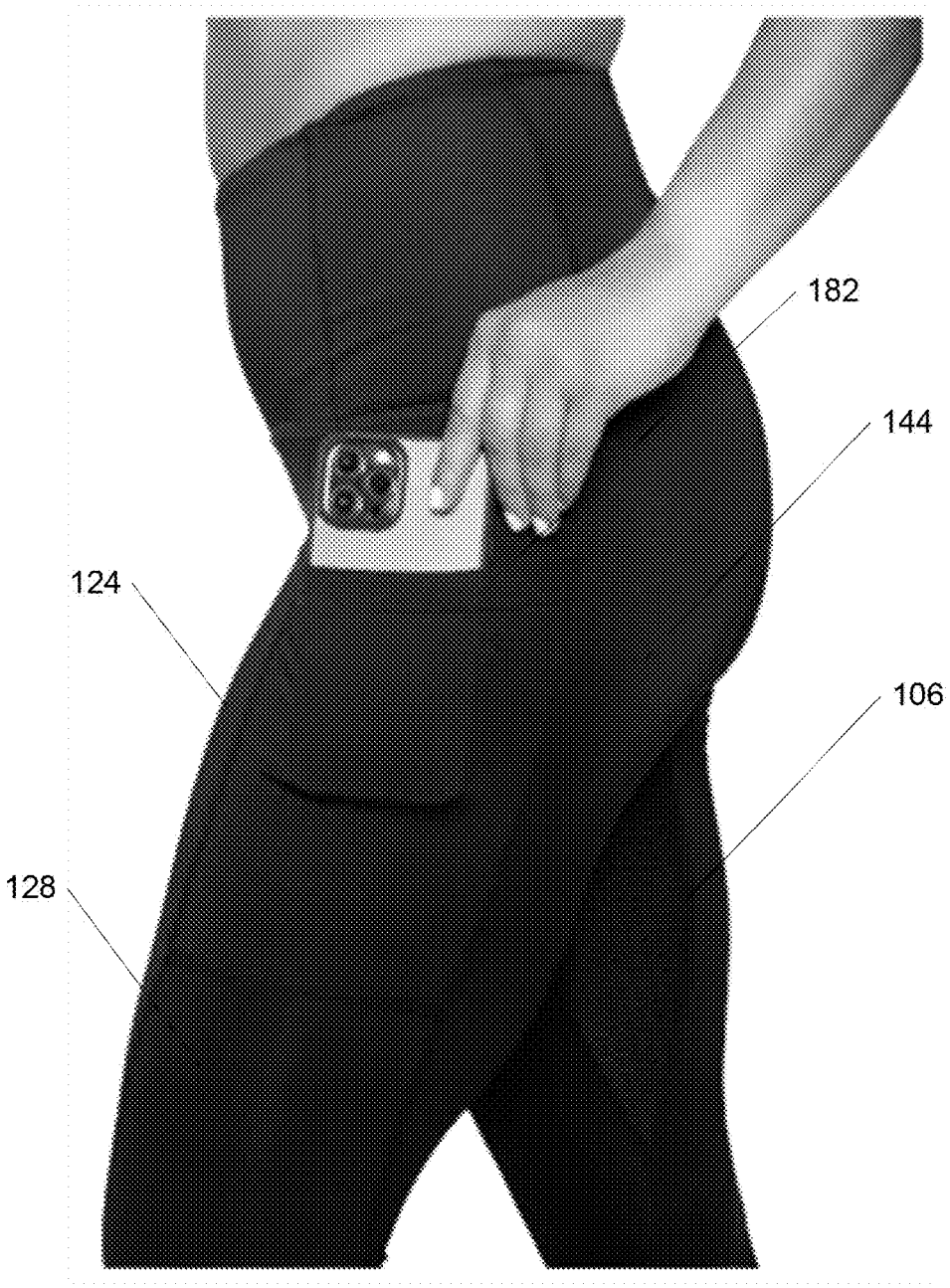
FIG. 1E is a left side view of leggings utilizing a crotch gusset assembly and inner thigh meshes in accordance with an embodiment of the invention.

In many embodiments, the first side panel 126 and the second side panel 128 may include pockets. For example, an additional piece of the primary legging fabric may be cut into a rectangular shape and sewn or otherwise bonded to the side panels 126, 128 to form each pocket. In some embodiments, the waistband 103, 105 may also include a hidden pocket on the inside of the waistband. For example, an additional piece of the primary legging fabric may be cut into a rectangular shape and sewn or otherwise bonded to the inside of the front and/or back waistband panels 103, 105 to form the waistband pocket (may also be referred to as "third pocket"). Right and left side views of leggings utilizing a crotch gusset assembly and inner thigh meshes in accordance with an embodiment of the invention are shown in FIGS. 1D-E. In some embodiments, the side panels 126, 128 may be attached at the top with the waistband. As illustrated in FIG. 1D, the first side panel 126 may be attached to the first front panel 122 and the first back panel 142. In some embodiments, the first side panel 126 may also include a first pocket 162. As illustrated in FIG. 1E, the second side panel 128 may be attached to the second front panel 124 and the second back panel 144. In some embodiments, the second side panel 128 may also include a second pocket 182.

In reference to FIGS. 1D-E, in many embodiments, the first and second side panels 126, 128 may start just below the waistband at approximately the user's hip and extend to the bottom of the leggings. In various embodiments, the first and second side panels 126, 128 may extend down depending on the desired length of the leggings. For example, for a full-length, the first and second side panels 126, 128 may extend to the bottom of a user's ankle. For a ⅞ length, the first and second side panels 126, 128 may extend to just above the ankle. For a ¾ length, the first and second side panels 126, 128 may extend to the user's calves.

In further reference to FIGS. 1D-E, the first and second inner thigh mesh panels 106, 108 may be shaped like a tall isosceles triangle with two long sides and a short, slightly concave base. In many embodiments, the first and second inner thigh mesh panels 106, 108 may be separate panels of fabric from the outer gusset panel. However, in some embodiments, the first and second inner thigh mesh panels 106, 108 and the outer gusset panel may be made from the same mesh to provide similar breathability and/or appearance. In various embodiments, the outer gusset panel may be positioned directly under the user's crotch to hide it from view from an observer looking directly at the user, so as not to draw unwanted attention to the user's crotch.

In further reference to FIGS. 1D-E, the short base of the first and second inner thigh mesh panels 106, 108 may fit against either side of the outer gusset panel. The pointed end of the second inner thigh mesh panel 108 may extend down the user's left leg. Likewise, the pointed end of the first inner thigh mesh panel 106 may extend down the user's right leg. As described herein, similar to the crotch gusset assemblies, the ventilation panels (e.g., first and second inner thigh mesh panels 106, 108) may be constructed to provide air flow while being discreet, to prevent unwanted attention being drawn to the inner thigh area.

Although specific leggings utilizing crotch gusset assemblies and inner thigh meshes in accordance with embodiments of the invention are discussed with respect to FIGS. 1A-1E, any of a variety of leggings, crotch gusset assemblies, and ventilation panels (e.g., inner thigh meshes) as appropriate to the requirements of a specific application can be used in accordance with embodiments of the invention. For example, leggings may include a singular leg panel instead of a leg constructed using a front, back, and side panels. Further, leggings with crotch gusset assemblies and inner thigh meshes may take on various forms of leggings such as, but not limited to, shorts (e.g., biker shorts), footed leggings, leggings with stirrups, etc. In addition, the various components may be made using a variety of materials such as, but not limited to, synthetic fibers, various fabrics, and/or fabric blends. Furthermore, mesh panels and mesh components may utilize various mesh patterns, materials, layers, etc. Crotch gusset assemblies in accordance with embodiments of the invention are discussed further below.

Crotch Gusset Assemblies

Figure 2:
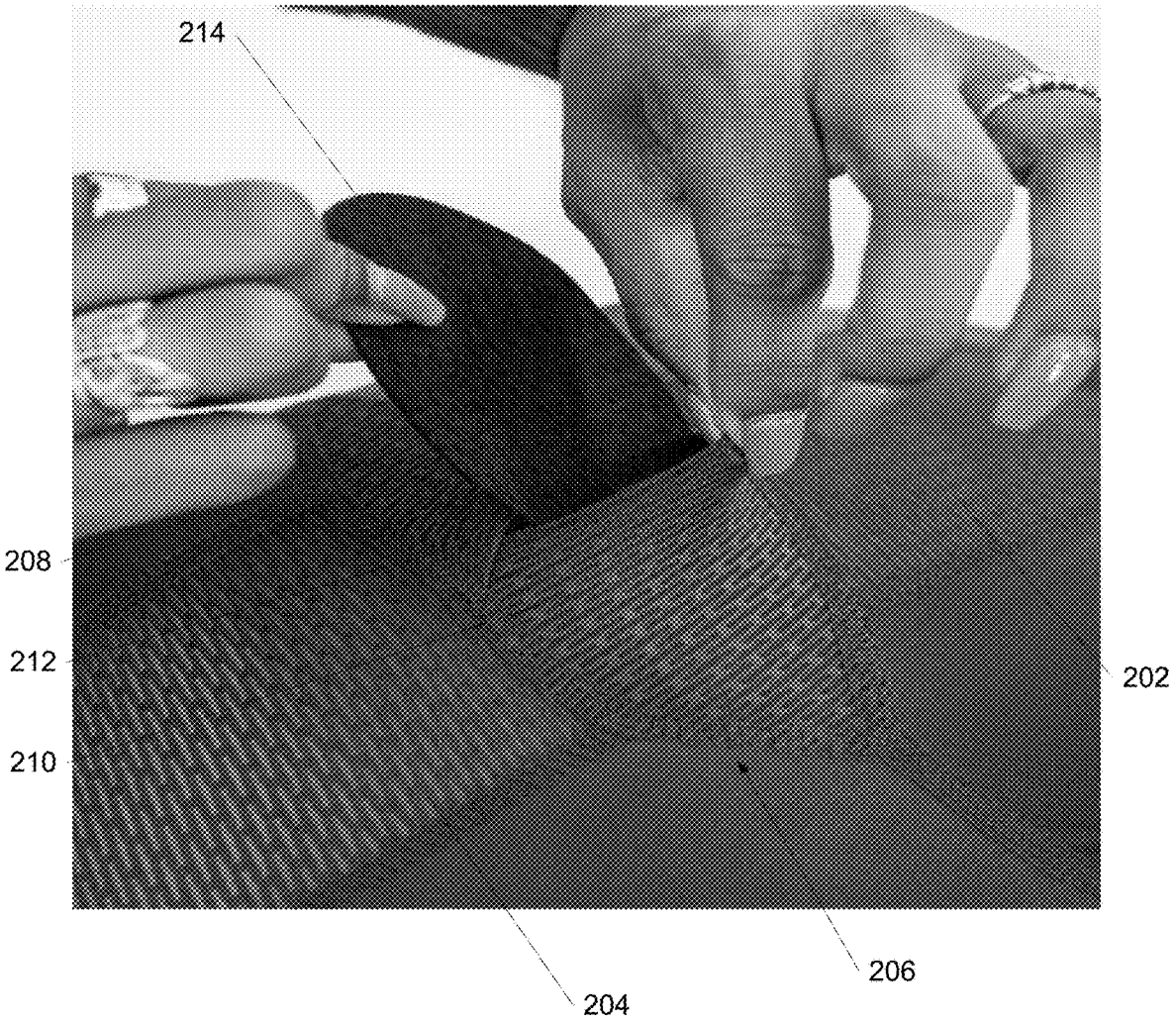
FIG. 2 is a perspective view of leggings turned inside out illustrating a crotch gusset assembly utilizing a reusable absorbent pad (may also be referred to as an "absorbent pad" or "pad") in accordance with an embodiment of the invention.

Leggings may include crotch gusset assemblies that may receive reusable absorbent pads for ventilation and moisture control. A perspective view of leggings turned inside out illustrating a crotch gusset assembly utilizing of an absorbent pad in accordance with an embodiment of the invention is shown in FIG. 2. In many embodiments, a crotch gusset assembly 206 may be positioned between a first inner thigh mesh panel 202 and a second inner thigh mesh panel 204, as described herein. The crotch gusset assembly 206 may include a top inside gusset panel 208 and a bottom inside gusset panel 210 constructed to provide an opening 212 for inserting and removing an absorbent pad 214. In various embodiments, the top and bottom inside gusset panels 208, 210 may be a rounded triangle shape and be meshed. The mesh construction may enable air flow between the two surface sides of the top and bottom inside gusset panels 208, 210. Air flow between the top and bottom inside gusset panels 208, 210 may help prevent the buildup of harmful bacteria or odors commonly accumulated during wear.

In reference to FIG. 2, the top and bottom inside gusset panels 208, 210 may be made using various fabrics. For example, the top and bottom inside gusset panels 208, 210 may made using antibacterial mesh fabric such as, but not limited to, polyester and Lycra. As further described below, the crotch gusset assembly 206 may also include an outer gusset panel that may be a football shape and forms the crotch on the outside of the leggings. In several embodiments, the outer gusset panel may be made using various fabrics. In some embodiments, the outer gusset panel may be made using mesh fabric with or without antibacterial properties such as, but not limited to, nylon and Lycra. In many embodiments, the absorbent pad 214 may be oval in shape (e.g., a football shape from an approximate 2D perspective).

Figure 3:
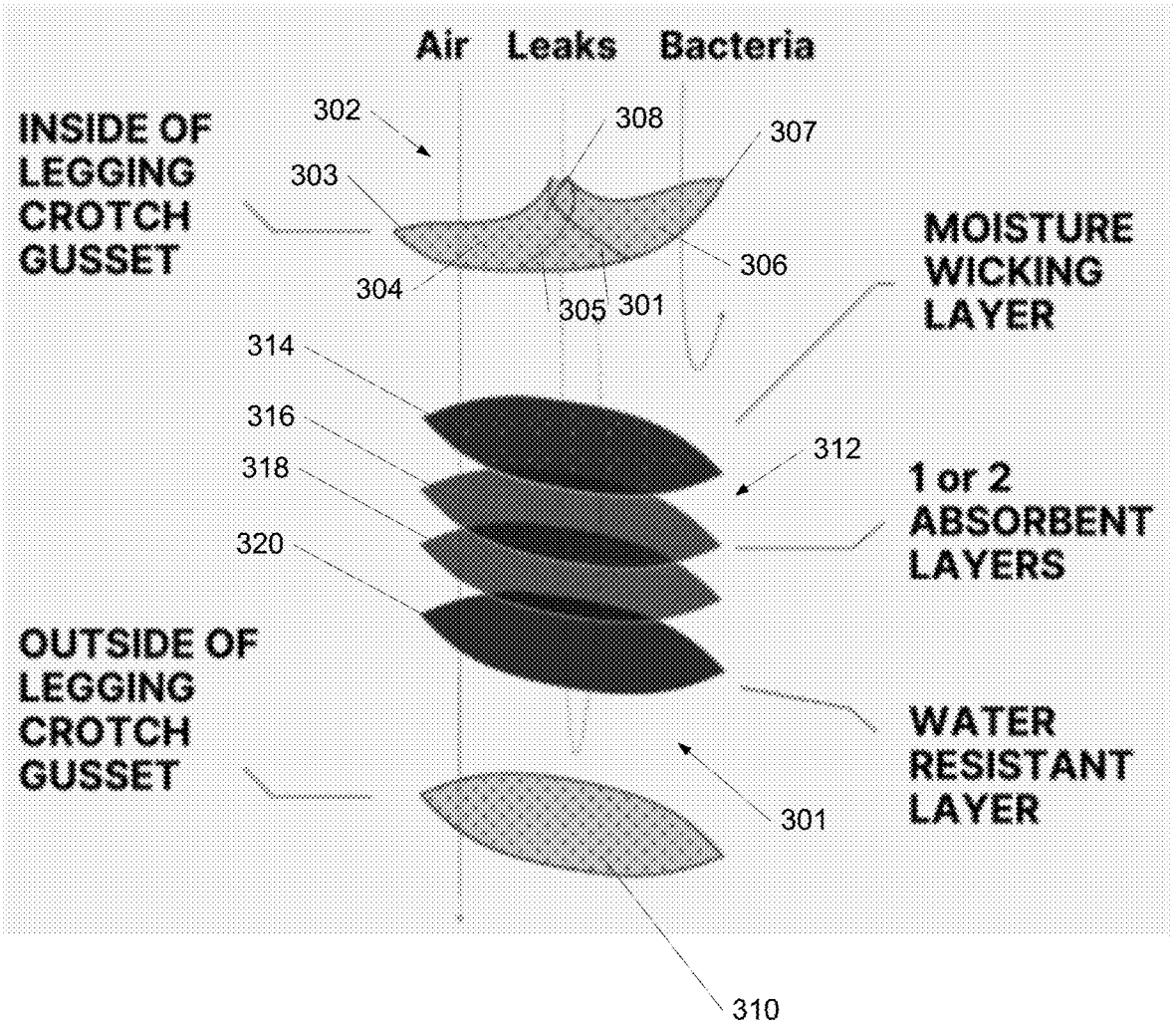
FIG. 3 is an exploded schematic view of a crotch gusset assembly with an absorbent pad inserted in accordance with an embodiment of the invention.

An exploded schematic view of a crotch gusset assembly with an absorbent pad inserted in accordance with an embodiment of the invention is shown in FIG. 3. The crotch gusset assembly may include a bottom inside gusset panel 306 that may be overlapped by a top inside gusset panel 304 to form overlapping inside gusset panels 302. In many embodiments, the top inside gusset panel 304 may include a first edge 301 which may be wider relative to a second edge 303 which may be tapered down to a point. In various embodiments, the bottom inside gusset panel 306 may also include a first edge 305 which may be wider relative to a second edge 307 which may be tapered down to a point. In some embodiments, the first edges 301, 303 and second edges 305, 307 may be positioned on opposite sides of each other. In some embodiments, the overlapping inside gusset panels 302 may create an opening 308 for receiving an absorbent pad 312. In some embodiments, an outer gusset panel 310 may form the bottom of the crotch gusset assembly. In some embodiments, the top and bottom inside gusset panels 304, 306 may be attached to the bottom gusset panel 310 to form a pocket 301 for retaining the absorbent pad 312. In some embodiments, the outer gusset panel 310 may be the fabric that may be visible from the outside of the leggings. In various embodiments, the outer gusset panel 310 may be constructed using the same mesh as the top and bottom inside gusset panels 304, 306 to provide maximum air flow.

In reference to FIG. 3, the removable absorbent pad 312 may be received via the opening 308. When the absorbent pad 312 is received into the crotch gusset assembly, the overlapping inside gusset panels 302 may naturally close the crotch gusset pocket 301 to conceal the absorbent pad 312. In many embodiments, the top and bottom inside gusset panels 304, 306 may be two-dimensional (2D) football shaped such that the pointed ends of the removable absorbent pad 312 stay fixed in place during wear. In various embodiments, the overlapping inside gusset panels 302 may be cut roughly the same size as the absorbent pad 312, such that inserting the pad 312 may be easy but the pad 312 does not shift around during wear. In a variety of embodiments, the overlapping inside gusset panels 302 may not use fasteners or buttons since such parts may be difficult to sew on the leggings' stretchy fabric and could cause tears in the fabric. Creating the crotch gusset assembly pocket 301 by using overlapping inside gusset panels 302 that naturally open and close also provides greater comfortability to the wearer than fasteners or buttons would, since the wearer only feels fabric, rather than fasteners or buttons.

In further reference to FIG. 3, the absorbent pad 312 may be slightly smaller in length and width as the outer gusset panel 310. Further, the absorbent pad 312 may also include a plurality of layers, and be removable, washable, and disposable. In many embodiments, the absorbent pad 312 may include a top layer 314 that may be constructed using fabric similar or identical to the fabric of the main legging fabric panels to blend in inconspicuously with the rest of the leggings. In some embodiments, the absorbent pad 312 may also include at least one mid layer such as a first mid layer 316 and a second mid layer 318 (may also be referred to as collectively as a "fluid absorbent mid pad" or "mid pad"). In some embodiments, the mid pad 316, 318 may be a double-sided pad constructed using absorbent material such as, but not limited to, a French terry cloth to provide maximum absorbency. In some embodiments, the mid pad 316, 318 may be between 0.2 cm-0.6 cm in thickness to maintain both absorbency and comfortability for the wearer. The absorbent pad 312 may also include a bottom layer 320 that may be water resistant. In some embodiments, the bottom layer 320 may be identical to the top layer 314 and both may have an antimicrobial coating to prevent build-up of harmful bacteria and/or odors.

Since the outer gusset panel 310 may be constructed of mesh, using a similar or identical fabric as the main legging fabric panels may help the presence of the absorbent pad 312 to be discrete and blend into the leggings. In many embodiments, the top layer 314, the at least one mid layer 316, 318, and the bottom layer 320 may be sewn, glued, and/or thermally bonded together in a 2D football shape to create the absorbent pad 312. As described above, the absorbent pad 312 may be inserted into the opening 308 by inserting one end of the absorbent pad 312 into the opening 308 until the pointed ends align. Then, the other end of the absorbent pad 312 may be fitted into the opposite side of the crotch gusset assembly until those pointed ends align. The two pointed ends of the naturally closing crotch gusset assembly pocket 301 of the overlapping inside gusset panels 302 may keep the absorbent pad 312 in place without assistance from additional reinforcements (e.g., buttons or fasteners) on the crotch area.

Figure 4A:
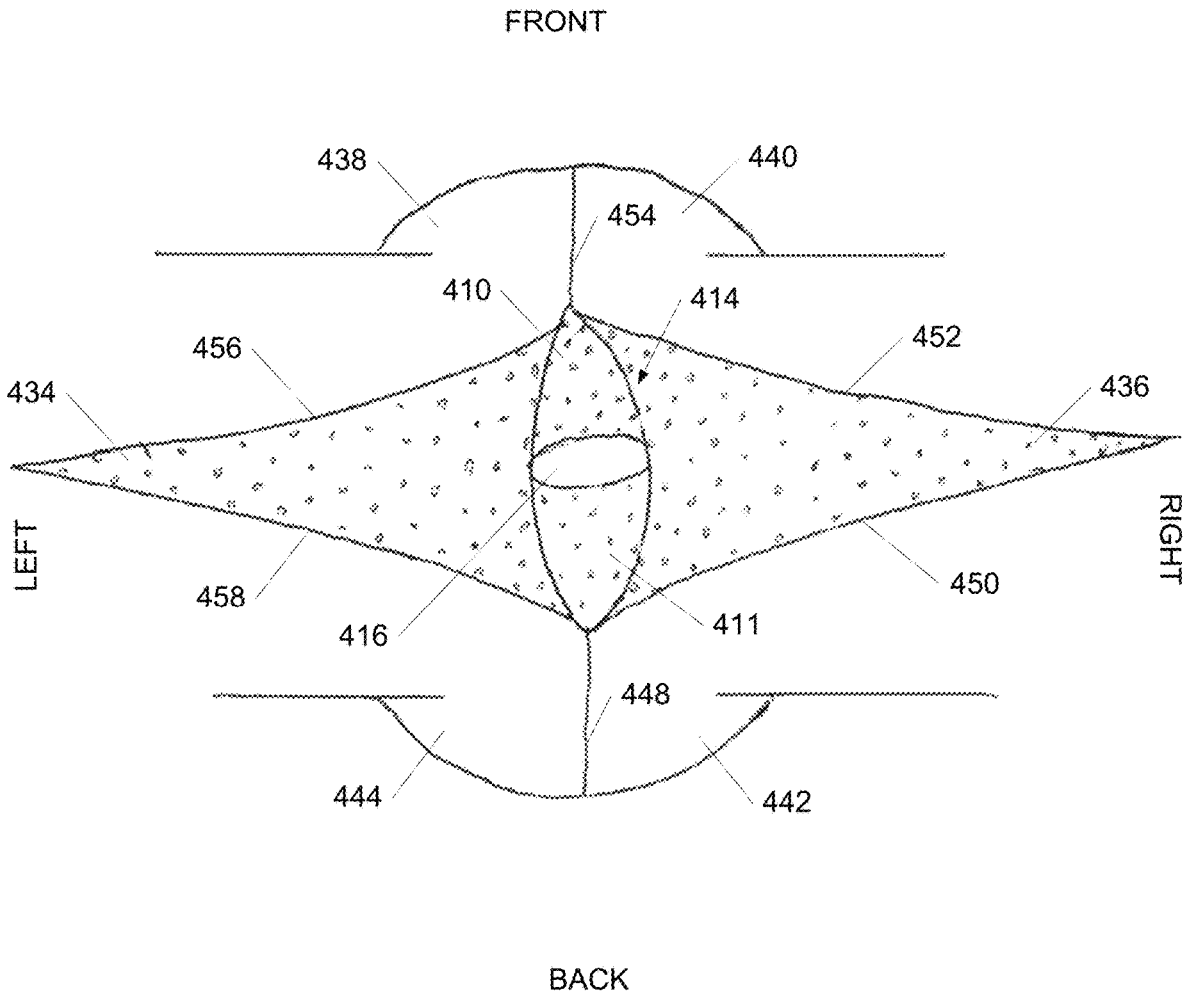
FIG. 4A is a diagram of a bottom view of leggings turned inside out illustrating construction of a crotch gusset assembly and inner thigh meshes in accordance with an embodiment of the invention.

A diagram of a bottom view of leggings turned inside out illustrating construction of a crotch gusset assembly and inner thigh meshes in accordance with an embodiment of the invention is shown in FIG. 4A. In many embodiments, the crotch gusset assembly may include an opening 416 for inserting and removing an absorbent pad, as further described above. In several embodiments, a top inside gusset panel 410 may overlap with a bottom inside gusset panel 411 to form overlapping inside gusset panels 414. In various embodiments, the top and bottom inside gusset panels 410, 411 may also be attached (e.g., sewn) on top of an outer gusset panel. In some embodiments, a concave base of the first inner thigh mesh panel 436 may be sewn to the right side of the overlapping gusset panels 414. Further, a first front panel 440 may connect to the first inner thigh mesh panel 436 and the overlapping inside gusset panels 414 at a seam 452 which may run the length of the side of the first inner thigh mesh panel 436. In some embodiments, a concave base of the second inner thigh mesh panel 434 may be attached (e.g., sewn) to the left side of the overlapping inside gusset panels 414. In addition, the second front panel 438 may connect to the second inner thigh mesh panel 434 and the overlapping inside gusset panels 414 at a seam 456 which may run the length of the side of the second inner thigh mesh panel 434. In several embodiments, the first and second front panels 440, 438 may be attached together at seam 454 which may run perpendicular to a seam connecting the first and second front panels 440, 438 to the front waistband panel. Moreover, this pattern may be reflected on the back half of the leggings. For example, the first back panel 442 may be attached to the first inner thigh mesh panel 436 at a seam 450. Further, the second back panel 444 may be attached to the second inner thigh mesh panel 434 at a seam 458. In some embodiments, the first and second back panels 442, 444 may be attached together at a seam 448 which may run perpendicular to a seam connecting the first and second back panels 442, 444 to the back waistband panel.

Figure 4B:
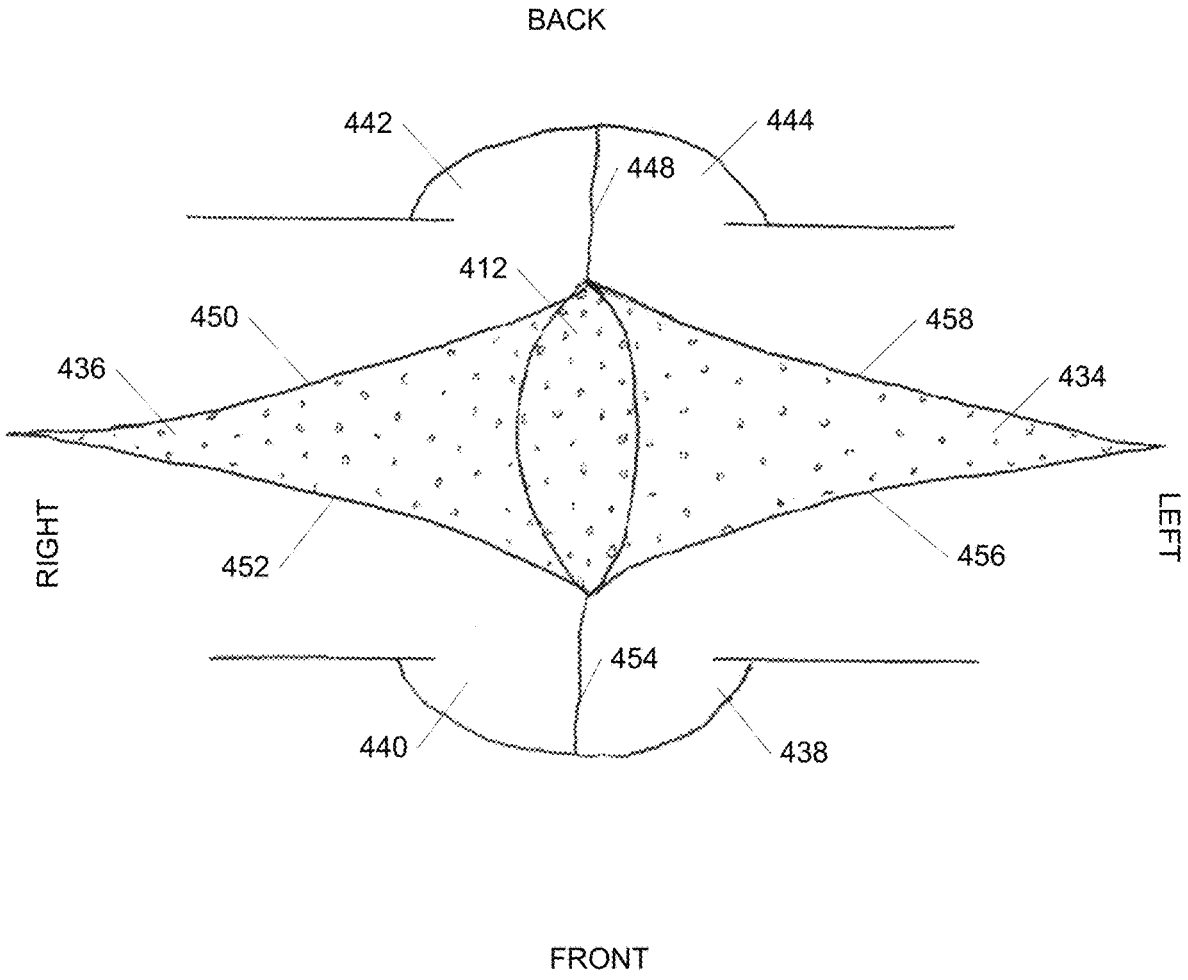
FIG. 4B is a diagram of a bottom view of leggings illustrating construction of a crotch gusset assembly and inner thigh meshes in accordance with an embodiment of the invention.

A diagram of a bottom view of leggings illustrating construction of a crotch gusset assembly and inner thigh meshes in accordance with an embodiment of the invention is shown in FIG. 4B. In many embodiments, the outer gusset panel 412 may be attached (e.g., sewn) to the bottom of the overlapping inside gusset panels 414. In some embodiments, the concave base of the first inner thigh mesh panel 436 may be attached (e.g., sewn) to the right side of the outer gusset panel 412. Further, the first front panel 440 may connect to the first inner thigh mesh panel 436 and the outer gusset panel 412 at a seam 452 which may run the length of the side of the first inner thigh mesh panel 436. In some embodiments, the concave base of the second inner thigh mesh panel 434 may be sewn to the left side of the outer gusset panel 412. Further, the second front panel 438 may connect to the second inner thigh mesh panel 434 and the outer gusset panel 412 at a seam 456 which may run the length of the side of the second inner thigh mesh panel 434. As described above, the first and second front panels 440, 438 may be attached together at seam 454 which may run perpendicular to a seam connecting the first and second front panels 440, 438 to the front waistband panel. Further, this pattern may also be reflected on the back half of the leggings. For example, the first back panel 442 may be attached to the first inner thigh mesh panel 436 at a seam 450. Moreover, the second back panel 444 may be attached to the second inner thigh mesh panel 434 at a seam 458. In some embodiments, the first and second back panels 442, 444 may be attached together at seam 448 which may run perpendicular to a seam connecting the first and second back panels 442, 444 to the back waistband panel.

Although specific crotch gusset assemblies and inner thigh meshes in accordance with embodiments of the invention are discussed with respect to FIGS. 2-4B, any of a variety of crotch gusset assemblies and inner thigh meshes as appropriate to the requirements of a specific application can be used in accordance with embodiments of the invention. For example, the top and bottom inside gusset panels may be a singular panel having an opening such as, but not limited to, a cutout for allowing the absorbent pad to be inserted and removed from the crotch gusset assembly. In addition, mesh material may be replaced with materials capable of providing ventilation and/or heat control without taking away from the invention. Processes for constructing leggings with crotch gusset assemblies and inner thigh mesh panels in accordance with embodiments of the invention are discussed below.

Construction Processes Utilizing Crotch Gusset Assemblies

Figure 5:
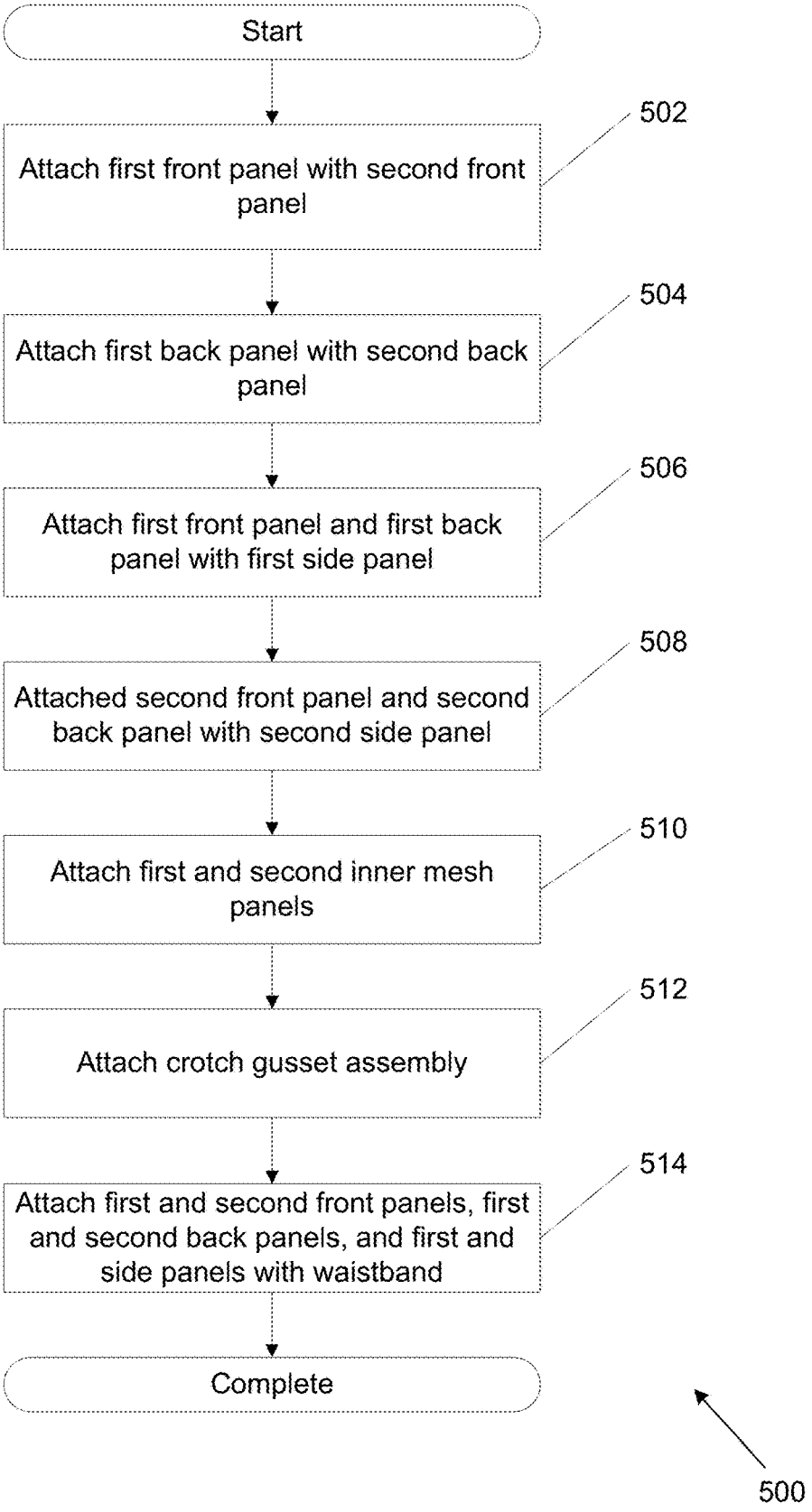
FIG. 5 is a flow chart illustrating a process of constructing leggings with a crotch gusset assembly and inner thigh meshes in accordance with an embodiment of the invention.

In many embodiments, various components (e.g., various panels, meshes, crotch gusset assemblies, etc.) of leggings may be attached using various methods such as, but not limited to, sewing, gluing (e.g., fabric gluing, hot gluing, etc.), pressing, taping, fusing, etc. A flow chart illustrating a process of constructing leggings with a crotch gusset assembly and inner thigh meshes in accordance with an embodiment of the invention is shown in FIG. 5. The process 500 may include attaching (502) a first front panel and a second front panel. The process 500 may also include attaching (504) a first back panel with a second back panel. Further, the process 500 may include attaching (506) the first front and back panels with a first side panel. Moreover, the process 500 may include attaching (508) the second front and back panels with a second side panel. In some embodiments, the process 500 may include attaching (510) first and second inner mesh panels, as further described below. In some embodiments, the process 500 may include attaching (512) a crotch gusset assembly, as further described below. Furthermore, the process 500 may include attaching (514) the first and second front panels, the first and second back panels, and the first and second side panels with a waistband.

Figure 6:
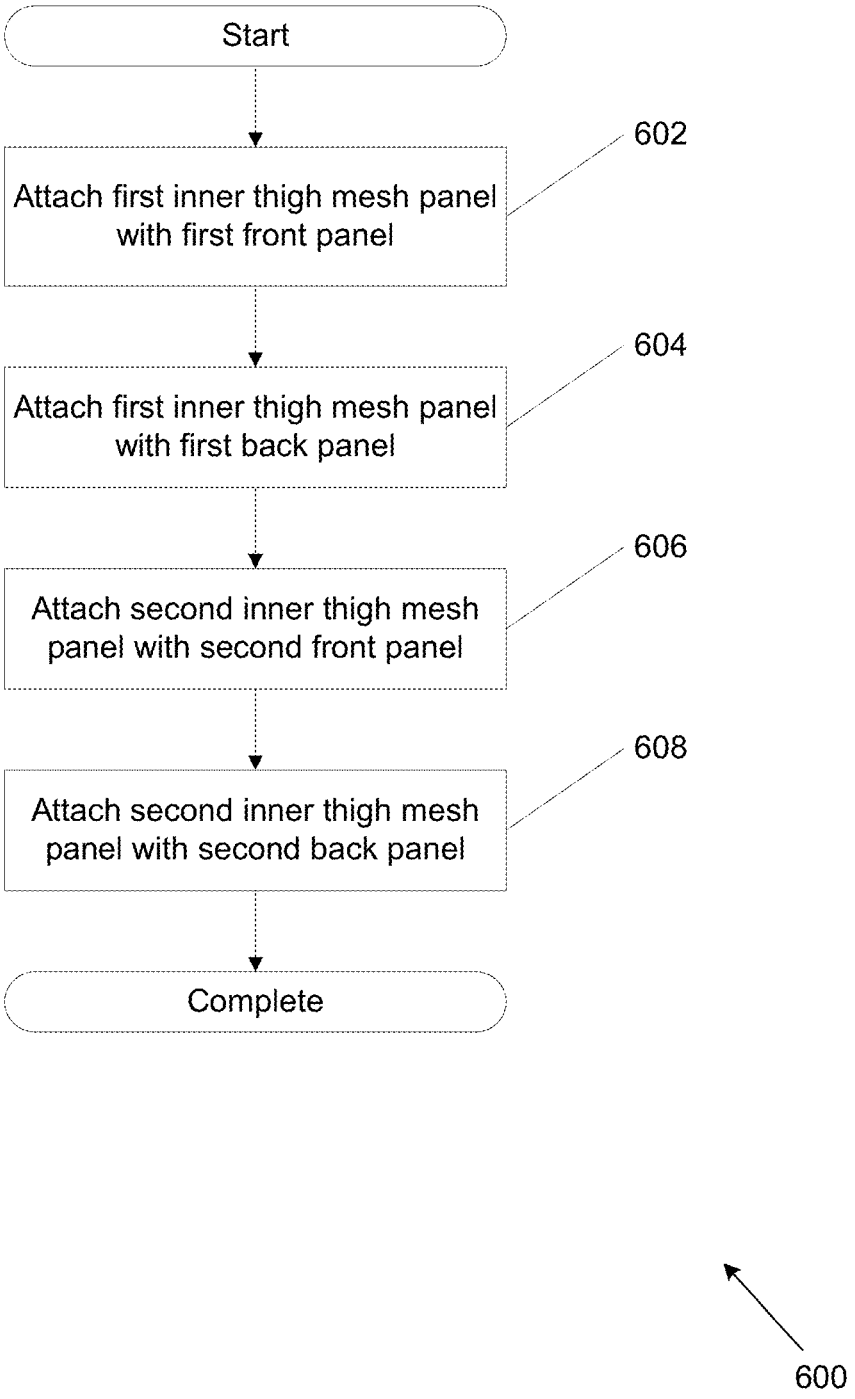
FIG. 6 is a flow chart illustrating a process of attaching first and second inner thigh meshes in accordance with an embodiment of the invention.

A flow chart illustrating a process of attaching first and second inner thigh meshes in accordance with an embodiment of the invention is shown FIG. 6. The process 600 may include attaching (602) the first inner thigh mesh panel with the first front panel. Further, the process 600 may include attaching (604) the first inner thigh mesh panel with and the first back panel. Moreover, the process 600 may include attaching (606) the second inner thigh mesh panel with the second front panel. The process 600 may also include attaching (608) the second inner thigh mesh panel with the second back panel.

Figure 7:
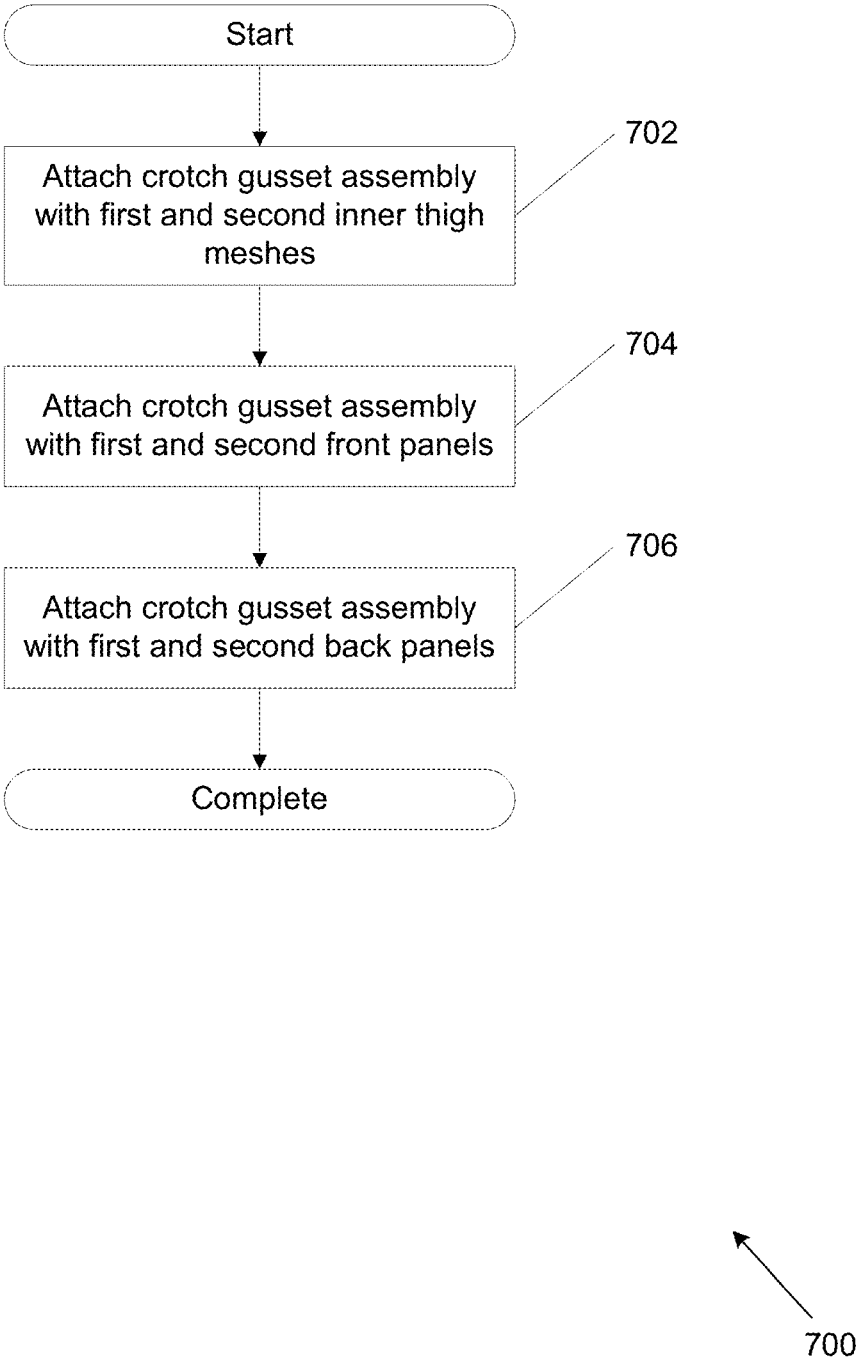
FIG. 7 is a flow chart illustrating a process of attaching a crotch gusset assembly in accordance with an embodiment of the invention.

A flow chart illustrating a process of attaching a crotch gusset assembly in accordance with an embodiment of the invention is shown in FIG. 7. The process 700 may include attaching (702) the crotch gusset assembly with the first and second inner thigh meshes. In some embodiments, the process 700 may also include attaching (704) the crotch gusset assembly with the first and second front panels. In some embodiments, the process 700 may also include attaching (706) the crotch gusset assembly with the first and second back panels.

Figure 8:
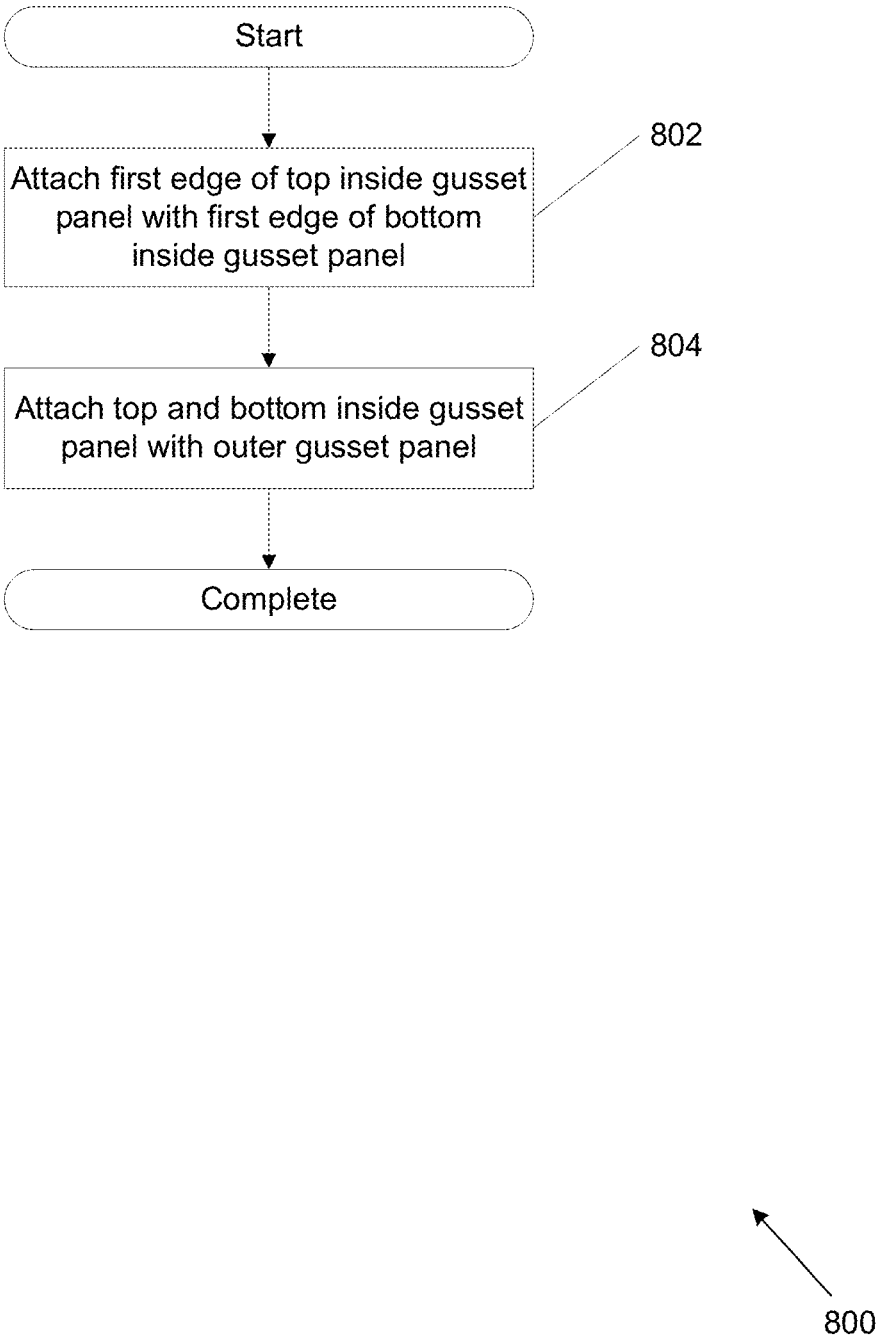
FIG. 8 is a flow chart illustrating a process of constructing a crotch gusset assembly in accordance with an embodiment of the invention.

A flow chart illustrating a process of constructing a crotch gusset assembly in accordance with an embodiment of the invention is shown in FIG. 8. The process 800 may include attaching (802) a first edge of a top inside gusset panel with a first edge of a bottom inside gusset panel. As described further above, the first edges of the top and bottom inside gusset panels may be wider, flat, and/or straight relative to opposite second edges which may be tapered to a point and/or narrower relative to the first edges. In some embodiments, the attaching (802) of the first edges of the top and bottom inside gusset panels may create an opening for allowing an absorbent pad to be inserted and removed from the crotch gusset assembly, as further described above. The process 800 may also include attaching (804) the top and bottom inside gusset panels with an outer gusset panel. In some embodiments, the top and bottom inside gusset panels may be attached (804) with the outer gusset panel along the edges as to provide a crotch gusset assembly pocket, as further described above.

Although specific processes for constructing leggings have a crotch gusset assembly and inner thigh meshes in accordance with embodiments of the invention are discussed with respect to FIGS. 5-8, any of a variety of processes as appropriate to the requirements of a specific application can be used in accordance with embodiments of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. Leggings having a crotch gusset assembly, the leggings comprising:

a first leg for receiving a user's first leg;

a second leg for receiving a user's second leg;

a first inner thigh mesh panel and a second inner thigh mesh panel for providing ventilation; and a crotch gusset assembly comprising at least one inside gusset panel and an outer gusset panel, wherein the at least one inside gusset panel and the outer gusset panel are attached to form a pocket for retaining a removable absorbent pad and wherein:

the at least one inside gusset panel comprises a top inside gusset panel and a bottom inside gusset panel;

the top inside gusset panel comprises a first edge and a second edge and the bottom inside gusset panel comprises a first edge and a second edge; and the first edge of the top inside gusset and the first edge of the bottom inside gusset are attached to form an opening of the crotch gusset assembly for receiving the removable absorbent pad.

2. The leggings of claim 1, wherein the first leg comprises a first front panel and a first back panel and wherein the second leg comprises a second front panel and a second back panel.

3. The leggings of claim 2, wherein the first front panel and the second front panel are attached and the first back panel and the second back panel are attached.

4. The leggings of claim 3, wherein:

the first inner thigh mesh panel and the first front panel are attached;

the first inner thigh mesh panel and the first back panel are attached;

the second inner thigh mesh panel and the second front panel are attached; and the second inner thigh mesh panel and the second back panel are attached.

5. The leggings of claim 4, wherein the crotch gusset assembly is attached to the first and second inner thigh mesh panels.

6. The leggings of claim 5, wherein the crotch gusset assembly is attached to the first and second front panels.

7. The leggings of claim 6, wherein the crotch gusset assembly is attached to and the first and second back panels.

8. The leggings of claim 4 further comprising a waistband providing an opening for entering and exiting the leggings, wherein the waistband is attached to the first and second front panels, and the first and second back panels.

9. The leggings of claim 4 further comprising a first side panel, wherein the first side panel is attached to the first front panel and the first back panel.

10. The leggings of claim 9 further comprising a first side pocket attached to the first side panel.

11. The leggings of claim 9 further comprising a second side panel, wherein the second side panel is attached to the second front panel and the second back panel.

12. The leggings of claim 11 further comprising a second side pocket attached to the second side panel.

13. The leggings of claim 1, wherein the top and bottom inside gusset panels are attached with the outer gusset panel to form the pocket of the crotch gusset assembly.

* * * * *